US005392892A

United States Patent [19]

Mulder

[11] Patent Number: 5,392,892

[45] Date of Patent: Feb. 28, 1995

[54] DEVICE FOR THE MEASUREMENT OF THE DIAMETER OF CIRCULAR OBJECTS

[75] Inventor: Arjen J. Mulder, Manubach, Germany

[73] Assignee: NSM Aktiengesellschaft, Bingen, Germany

[21] Appl. No.: 46,228

[22] Filed: Apr. 13, 1993

[30] Foreign Application Priority Data

Apr. 14, 1992 [DE] Germany ..... 4212500
Aug. 6, 1992 [DE] Germany ..... 4226062

[51] Int. Cl.[6] ..... G07D 5/02
[52] U.S. Cl. ..... 194/334; 250/223 R
[58] Field of Search ..... 194/334, 205, 212, 302; 250/223 R; 73/163

[56] References Cited

U.S. PATENT DOCUMENTS

| | | | |
|---|---|---|---|
| 3,699,981 | 10/1972 | Conant et al. | 194/334 |
| 3,797,307 | 3/1974 | Johnston | 73/163 |
| 4,148,388 | 4/1979 | Reyner et al. | 194/205 |
| 4,267,916 | 5/1981 | Black et al. | 194/334 X |
| 4,474,281 | 10/1984 | Roberts et al. | 194/334 X |
| 4,509,633 | 4/1985 | Chow | 194/334 |
| 4,546,868 | 10/1985 | Gregory, Jr. | 194/203 |
| 4,585,936 | 4/1986 | Sellier | 194/334 X |
| 4,646,904 | 3/1987 | Hoormann | 194/334 |
| 4,667,093 | 5/1987 | MacDonald | 194/334 X |
| 5,033,603 | 7/1991 | Kai et al. | 194/334 |

FOREIGN PATENT DOCUMENTS

| | | | |
|---|---|---|---|
| 2851668 | 6/1980 | Germany . | |
| 268547 | 5/1989 | Germany | 194/334 |
| 3910824 | 11/1989 | Germany | 194/334 |
| 1375601 | 11/1974 | United Kingdom . | |
| 1580425 | 12/1980 | United Kingdom . | |
| 2176038 | 12/1986 | United Kingdom | 194/334 |

*Primary Examiner*—David A. Bucci
*Assistant Examiner*—Scott L. Lowe
*Attorney, Agent, or Firm*—Dilworth & Barrese

[57] ABSTRACT

For the measurement of the diameter of coins (1) or other circular objects, such coins or other objects pass the guide channel at substantially the same velocity. In a lateral wall of the guide channel, at least two photoelectric detectors (3, 4) are arranged at different heights which are obscured by such coins or other circular objects when passing the channel (FIG. 1 ).

11 Claims, 2 Drawing Sheets

DEVICE FOR THE MEASUREMENT OF THE DIAMETER OF CIRCULAR OBJECTS

BACKGROUND OF THE INVENTION

The invention relates to a device for the measurement of the diameter of coins or other circular objects comprising an oblique guide channel along which such coin or other object passes at substantially the same velocity, at least in a part thereof.

In automatic vending machines, money changing machines or gambling machines, after being put in the slot the coins normally pass along oblique guide channels to a coin unit in which the coin is tested to see if it is genuine, sorted, stacked and/or passed to return or issuing plates or to collecting containers simply and reliably.

In order to ascertain the value and/or test the genuineness of coins the measurement of their diameter is an additional criterion. One object of the invention is consequently to create a machine of the type initially mentioned with which the diameter of coins and of other circular objects can be measured.

SUMMARY OF THE INVENTION

In accordance with the invention and in the case of a device of the generic type, this object is attained by the feature that in a lateral wall of the guide channel, at least two photoelectric detectors are arranged at different heights, which are obscured upon the passage past the same of a coin or other circular object.

In the device in accordance with the invention, the guide channel is preferably arranged at a slope so that owing to gravity the coin moves along it at essentially the same velocity. This constant velocity is as a consequence of the rolling resistance and acceleration generally corresponding to each other so that no substantial acceleration occurs. Moreover, the photoelectric detectors are arranged at a point where it is expected that the coins will have a substantially the same velocity. Of the two photoelectric detectors provided in accordance with the invention, the one which is firstly obscured starts a timer, which is halted when the second photoelectric detector is obscured. From the time between the obscuring of the first and then the second photoelectric detector and from the known velocity of movement of the coin, it is possible to ascertain two points on the outline of the coin. A third relevant point on the outline is the point of engagement with the guide channel so that on the basis of the signals of the two photoelectric detectors in relation to each other and to the floor of the guide channel, it is possible to ascertain three points on the outline of the coin to be measured. From such points, it is possible to compute the diameter of the coin.

The timer may, for instance, include a timing means which receives pulses of a predetermined constant frequency so that the number of the pulses counted between starting and halting .of the counter will be a measure for the distance of the points on the periphery of the coin on a line parallel to the floor of the channel.

It is convenient if two photoelectric detectors are arranged on a line which is at a right angle to the flat floor of the guide channel. In this respect, it is convenient if one photoelectric detector is arranged adjacent to floor of the guide channel and the other is arranged at a certain height above the floor corresponding to the radius of the coin of medium size to be measured.

In order also to be able to more accurately measure velocity of the coins on their passage past the photoelectric detectors, in accordance with a further form of the invention another photoelectric detector is arranged spaced from one of the photoelectric detectors and at the same height. It is convenient if this additional photoelectric detector is associated with the upper photoelectric detector. In the case of this form of the invention, the photoelectric detector which is firstly obscured starts two timers which are halted when the second photoelectric detector is obscured. In this case the time measured between the points in time at which the two photoelectric detectors arranged at the same level are obscured is used to find the velocity of the coin which is to be measured.

In yet another possible form of the invention in addition to the photoelectric detectors arranged one over the other, a further photoelectric detector is provided in the direction of movement of the coin at a distance in front of the upper photoelectric detector, which distance is greater than the diameter size of the coins to be measured. This arrangement means, on the one hand, that the time can be measured during which the coin is moving along the path between the pair of upper photoelectric detectors, and on the other hand, it is possible to ascertain the time between obscuring the upper and lower photoelectric detectors which are arranged over each other. From the ratio between the these two times, it is possible to find the relative size of the coin.

BRIEF DESCRIPTION OF THE DRAWINGS

The following detailed descriptive disclosure relates to one embodiment of the invention as illustrated in the accompanying drawings.

DESCRIPTION OF THE PREFERRED EMBODIMENTS

Figure 1:
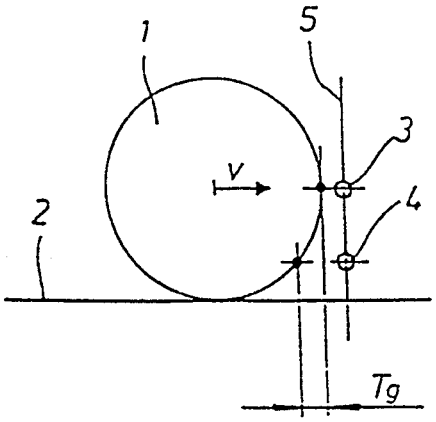
FIG. 1 is a diagrammatic view of a guide channel along which a large coin is moving.

The coin 1 shown in FIG. 1 is rolling at the velocity v on the obliquely set floor 2 of a coin guide channel, which is delimited by two lateral walls. In these lateral walls, two photoelectric detectors 3 and 4 are arranged in alignment with a line 5 which is perpendicular to the floor 2. The photoelectric detector 3 is positioned at a height above the floor 2 which is the same as the radius of the coin 1, whereas the photoelectric detector 4 is arranged very close to the floor.

The photoelectric detectors 3 and 4 may be reflected light photoelectric detectors or detectors each comprising an emitter and a receiver.

Figure 2:
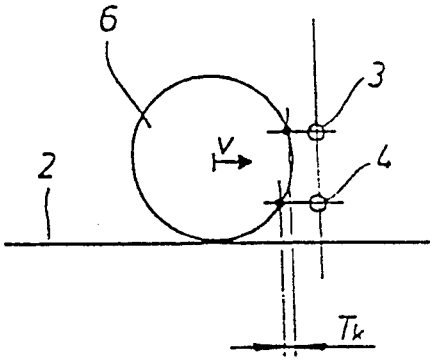
FIG. 2 shows the guide channel in accordance with FIG. 1 while a smaller coin is moving along it.

FIG. 2 shows the same guide channel 2, in whose walls the photoelectric detector 3 and 4 are arranged and along which a coin 6 with a small diameter moves.

If the velocity v of the coins 1 and 6 on moving past the photoelectric detectors 3 and 4 is assumed to be constant, it is possible to find, on the basis of time measured between the obscuring of the first photoelectric detector 3 and the second photoelectric detector 4, the distances Tg and Tk from which it is then to compute two points on the outline of the coins. Because the coin rolls on the floor 2 of the guide channel and since additionally the height of the two points above the floor is known, it is possible, on the basis of the points measured and the geometry of the guide channel with the photoelectric detectors to derive the diameter of the coins.

Figure 3:
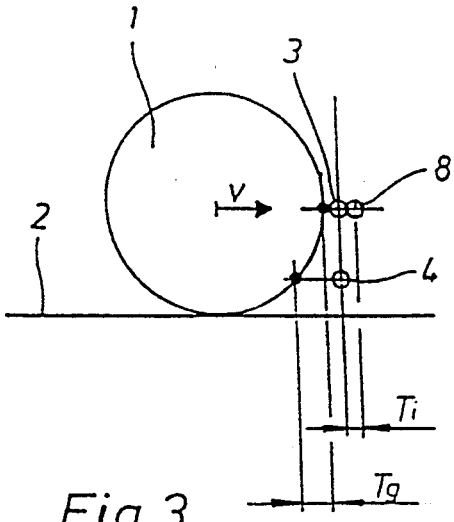
FIG. 3 shows a guide channel corresponding to FIGS. 1 and 2, in whose side wall two photoelectric detectors are arranged at the same level and a small distance apart.
Figure 4:
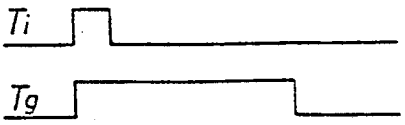
FIG. 4 represents the pulses produced by the photoelectric detector as depicted in FIG. 3.

In the case of the working embodiment in accordance with FIG. 3, an additional photoelectric detector 8 is arranged at a predetermined, small distance following the photoelectric detector 3 in the direction of movement of the coin and at the same height above the floor 2 of the guide channel. When the coin 1 now runs along the guide channel, firstly the photoelectric detector 3 will be obscured and it will start the two timers. The first timer is halted when photoelectric detector 8 is obscured so that there will be the pulse duration Ti. When the photoelectric detector 4 is obscured, the second counter will be halted so that there is the pulse duration Tg. In this respect the pulse duration Ti is a measure for the velocity, so that taking this measured velocity it is possible to very accurately ascertain the distance Tg, for it may be assumed that the velocity between the obscuring of the photoelectric detectors 3 and 4 changes to only a negligible degree if at all.

Figure 5:
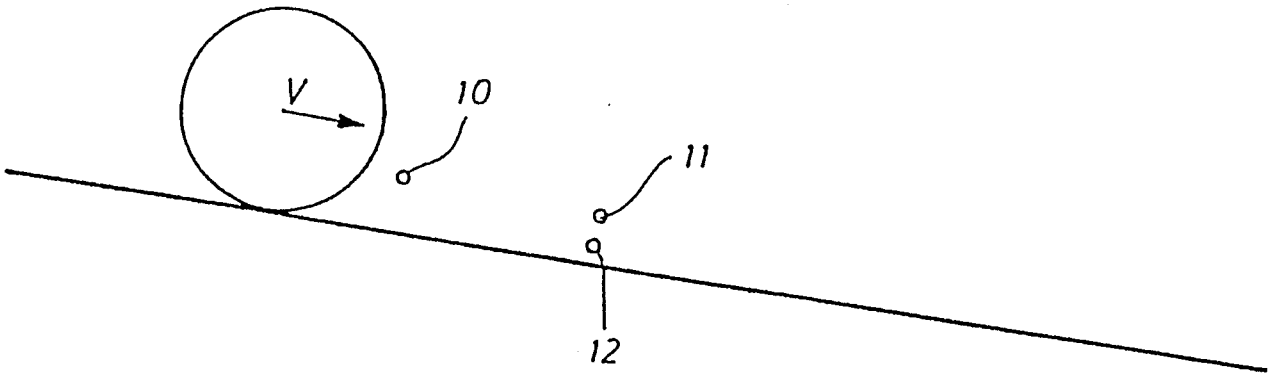
FIG. 5 is a view corresponding to FIG. 1, in which a further photoelectric electric detector is arranged in front of the upper photoelectric detector at a distance which is greater than the diameter of the largest coin to be measured.
Figure 6:
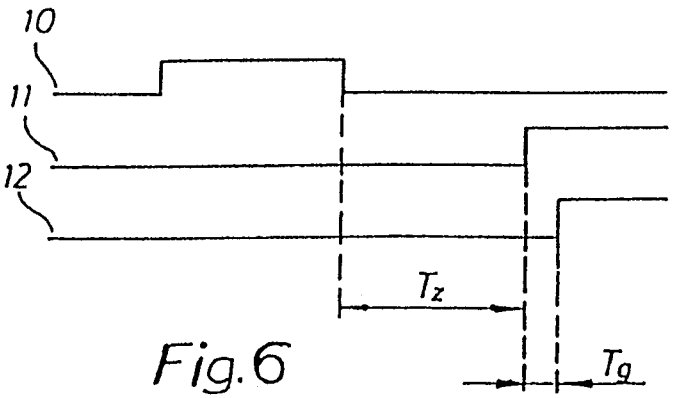
FIG. 6 shows graphs of the pulses produced by the photoelectric detector as a coin moves past them.

FIG. 5 shows an arrangement corresponding to the arrangement depicted in FIGS. 1 and 2, in the case which two photoelectric detectors 11 and 12 are arranged on a line which is perpendicular to the oblique path of the guide channel. In the direction of motion of the coin prior to the photoelectric detectors 11 and 12, there is a further photoelectric detector 10 arranged at the same height and at a distance from the photoelectric detector 11 greater than the diameter of the largest coin to be measured. As may be seen from the graph of the pulses, the photoelectric detectors 10 and 11 serve to measure the time Tz while the coin is moving along the path between the two photoelectric detectors 10 and 11.

Since the photoelectric detector 11 is arranged at a higher level than the photoelectric detector 12 and on a line perpendicular to the path of motion, the photoelectric detector 12 will always be obscured later than the photoelectric detector 11. It is possible to ascertain the time difference Tg from this. The ratio Tz/Tg is a measure for the relative size of the coins to be measured.

We claim:

1. A device for the measurement of the diameter of circular objects comprising an oblique guide channel along which such object passes at substantially the same velocity at least along a part thereof, characterized in that in a lateral wall of the guide channel, two photoelectric detectors are arranged at different heights on a line which is perpendicular to a flat floor of the guide channel, said photoelectric detectors obscured upon passage past the same of such circular object, a further photoelectric detector is arranged at a distance from one of said two photoelectric detectors at the same height as said one photoelectric detector, and a first one of said photoelectric detectors which is obscured is adapted to start two timers, a first timer which is halted by obscuring of a second one of said photoelectric detectors and a second timer which is halted by obscuring of a third one of said photoelectric detectors.

2. The device as claimed in claim 1, characterized in that the further photoelectric detector is associated with an upper one of said two photoelectric detectors.

3. The device as claimed in claim 1, wherein said further photoelectric detector is arranged at a distance from said one photoelectric detector in a direction of movement of the object along the channel.

4. The device as claimed in claim 1, wherein a lower one of said two photoelectric detectors is arranged adjacent the guide channel floor and an upper one of said two photoelectric detectors is arranged a certain height above the guide channel floor corresponding to a radius of an object of medium size to be measured.

5. The device as claimed in claim 1, wherein said photoelectric detectors are reflected light photoelectric detectors or detectors each comprising an emitter and a receiver.

6. The device as claimed in claim 1, wherein said first timer provides a pulse duration, $T_i$, which is a measure of velocity of the object.

7. The device as claimed in claim 6, wherein said second timer provides a pulse duration, $T_g$, and additionally comprising means for calculating size of the object based upon a ratio $T_i/T_g$.

8. A device for the measurement of the diameter of circular objects comprising an oblique guide channel along which such object passes at substantially the same velocity at least along a part thereof, characterized in that in a lateral wall of the guide channel, at least two photoelectric detectors are arranged at different heights on a line which is perpendicular to a flat floor of the guide channel, said photoelectric detectors obscured upon passage past the same of such circular object, and an additional photoelectric detector is arranged, in the direction of motion of the object, in front of an upper one of said two photoelectric detectors and at a distance therefrom greater than the largest diameter of the objects to be measured.

9. The device as claimed in claim 8, wherein a lower one of said two photoelectric detectors is arranged adjacent the guide channel floor and said upper one of said two photoelectric detectors is arranged a certain height above the guide channel floor corresponding to a radius of an object of medium size to be measured.

10. The device as claimed in claim 8, additionally comprising means for measuring time, $T_z$, the object moves along a path between the pair of upper photoelectric detectors, means for ascertaining time, $T_g$, between obscuring of said upper one and said lower one of said two photoelectric detectors on the perpendicular line, and means for calculating a ratio between times $T_z/T_g$ to ascertain relative size of the object.

11. The device as claimed in claim 8, wherein said photoelectric detectors are reflected light photoelectric detectors or detectors each comprising an emitter and a receiver.

* * * * *